United States Patent [19]

Galland

[11] 4,400,106

[45] Aug. 23, 1983

[54] TYPESETTING APPARATUS

[75] Inventor: Frank J. Galland, Windsor, England

[73] Assignee: Patology Press, Ltd., Windsor, England

[21] Appl. No.: 635,835

[22] Filed: Nov. 28, 1975

[30] Foreign Application Priority Data

Nov. 29, 1974 [GB] United Kingdom ..... 51703/74

[51] Int. Cl.[3] ..... B41J 15/00

[52] U.S. Cl. ..... 400/617; 400/174; 400/306; 400/615.2; 101/110

[58] Field of Search ..... 197/49, 55, 133 R, 133 A, 197/133 T, 84 A, DIG. 4; 101/93, 33, 110

[56] References Cited

U.S. PATENT DOCUMENTS

| | | | |
|---|---|---|---|
| 198,237 | 12/1877 | Drummond | 197/DIG. 4 |
| 1,013,477 | 1/1912 | Cornwall | 197/DIG. 4 |
| 1,484,568 | 2/1924 | Savage | 197/DIG. 4 |
| 1,992,017 | 2/1935 | Spielvogel | 197/DIG. 4 |
| 2,177,539 | 10/1939 | Spielvogel | 197/84 A X |
| 2,711,779 | 6/1955 | Carland | 197/172 UX |
| 2,790,386 | 4/1957 | Klaus | 101/110 X |
| 2,887,941 | 5/1959 | Horne | 197/84 A UX |
| 2,912,091 | 11/1959 | Gemmel | 197/49 |
| 2,919,641 | 1/1960 | Pfleger | 101/110 X |
| 3,110,250 | 11/1963 | Fradkin | 197/49 X |
| 3,207,067 | 9/1965 | Schaller | 101/93.33 |
| 3,273,685 | 9/1966 | Holliday | 197/84 A |
| 3,318,430 | 5/1967 | Boyd | 101/110 UX |
| 3,362,517 | 1/1968 | Ryan et al. | 197/55 X |
| 3,385,213 | 5/1968 | Stephan | 101/110 |
| 3,485,164 | 12/1969 | Bossi | 101/110 |
| 3,743,071 | 7/1973 | Luk | 197/49 X |
| 3,802,546 | 4/1974 | Helms | 197/133 R |
| 4,013,005 | 3/1977 | Keefe | 101/110 |

FOREIGN PATENT DOCUMENTS

| | | | |
|---|---|---|---|
| 1611170 | 10/1969 | Fed. Rep. of Germany | 197/84 A |

*Primary Examiner*—Ernest T. Wright, Jr.

[57] ABSTRACT

A typesetter with a continuously rotating character drum that places lines of character images on thin transparent tape, equalizes line lengths for margin justification by stretching the tape, and places the lines on transparent film in a form suitable for direct imposition in making positive-working plates for lithographic printing. It provides multiple type fonts and fonts of different typographic size on-line simultaneously, proportional spacing by lands on the character drum that advance the tape the requisite amount for each character depending on its length, and margin justification controlled by optical mark reading.

2 Claims, 6 Drawing Figures

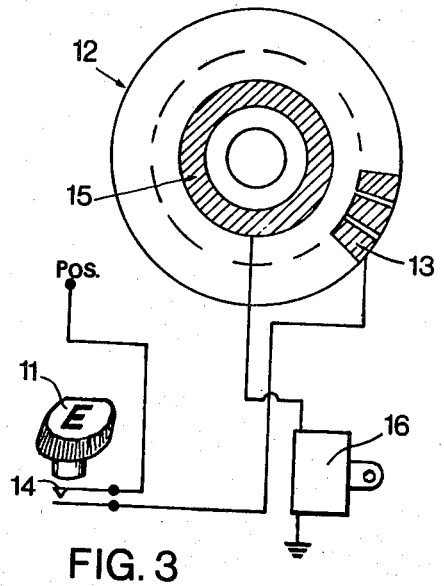
FIG. 3
FIG. 4
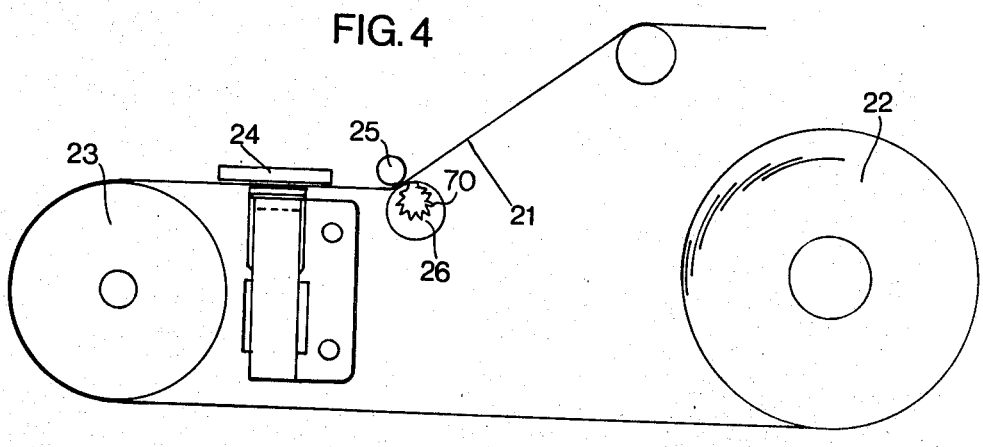

TYPESETTING APPARATUS

FIELD OF THE INVENTION

The invention relates to typesetting apparatus in which tape is the image receiving medium.

DESCRIPTION OF THE PRIOR ART

Mechanised typesetting is conventionally accomplished by three methods, namely, typewriting, hot metal, and photosetting. In typewriting, copy produced on paper is photographed and the resulting negative is used to prepare a plate for lithographic printing. In hot metal, embossed characters are cast on metal slugs and these are clamped in position either for direct use on a press in letterpress printing or they are hand inked to produce a single copy on paper which is photographed with the resulting negative used, as with typewritten copy, to prepare a plate for lithographic printing. In photosetting, a keyboard device like a typewriter typically produces a punched tape that is input to a photosetter in which character images from a matrix are projected onto film and the film, when processed, is used to prepare a plate for lithographic printing in the same manner as the film produced by photographing copy from typewriting or hot metal setting. Though there are variations on the foregoing, all methods currently used in quality lithographic printing employ a photographic step between keyboarding or copy preparation and platemaking. This is costly in materials because of the photographic film and chemicals required and costly in time because several hours must normally intervene between the time copy is set and the time plates can be made.

SUMMARY OF THE INVENTION

In its most significant embodiment, the invention is intended to overcome the disadvantages of using a photographic step between setting type and preparing lithographic plates for printing.

Briefly, in this embodiment, it provides for setting type (usually, herein, referred to as 'character images') on thin, transparent tape, stretching the tape to lengthen lines of character images thereon, and placing segments of the tape onto a transparent backing medium with the lines of character images in marginal alignment to form justified copy that can be used directly to prepare a lithographic plate.

According to one feature of the invention, character images are placed on tape by placing the tape in selective contact with image-forming characters on the periphery of a rotating drum, the drum having lands on its peripheral surface to engage and advance the tape as character images are placed on it.

According to another feature of the invention, the drum has circles of image-forming characters of different type fonts on its periphery and the font from which character images are placed on the tape is changed by axially moving the drum.

According to a further feature of the invention, the tape is moved from the place where character images are placed on it from the drum to a place where it is stretched to lengthen lines of character images to justified length and then placed onto a backing medium with lines of character images in marginal alignment.

According to a still further feature of the invention, the drum contains a special image-forming character that is used to place detectable marks adjacent to the ends of lines of character images and these are detected (preferrably by photosensitive devices) to control tape stretching.

BRIEF DESCRIPTION OF THE DRAWING

FIG. 3 is a schematic view of part of the apparatus of FIG. 2; and

FIG. 4 is a schematic end elevation of the apparatus of FIG. 1.

DESCRIPTION OF THE PREFERRED EMBODIMENTS

Figures 1, 1A:
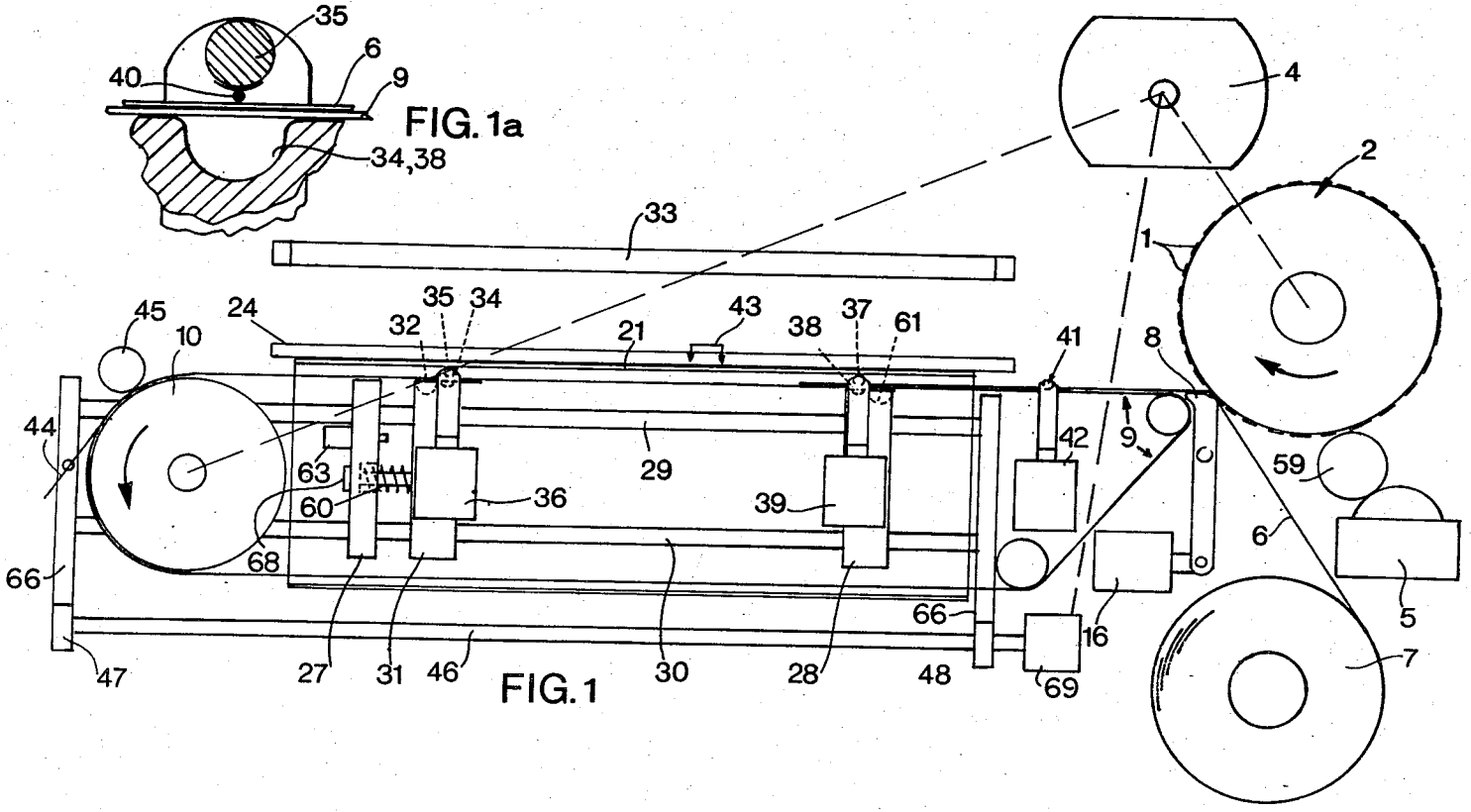
FIG. 1 is a schematic side elevation of a portion of an apparatus in accordance with the concepts of the invention.
FIG. 1*a* is an enlarged sectional view of the tape clamping and cutting elements of the apparatus.
Figure 2:
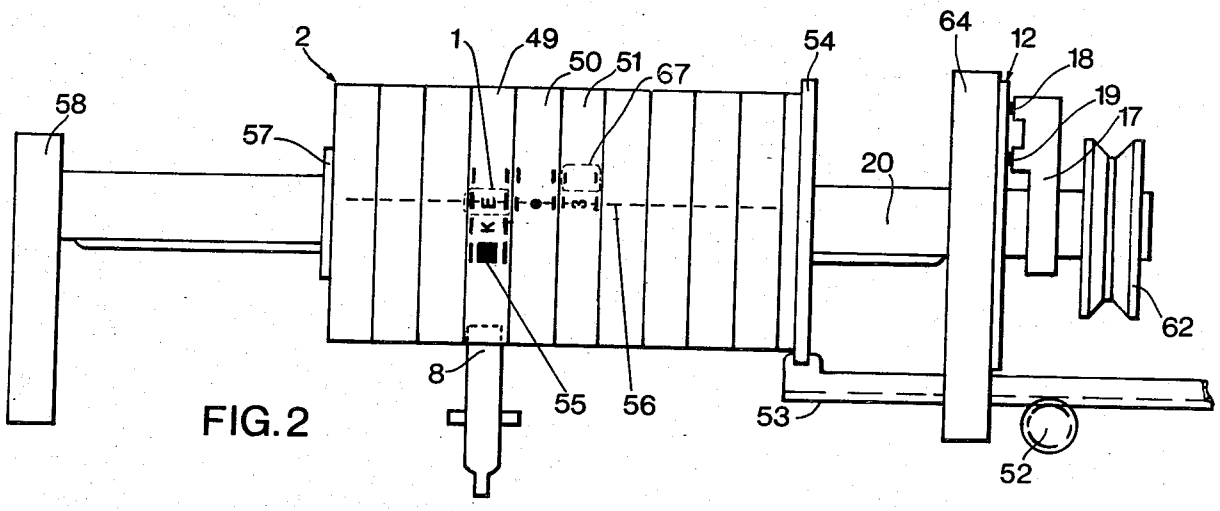
FIG. 2 is a schematic side elevation of the character drum and related elements of the apparatus of FIG. 1.

Referring to the drawing, and firstly to FIGS. 1 and 2, the apparatus includes type fonts in the form of drum 2 around the circular periphery of which are located character elements 1, the drum 2 being rotatable by motor 4 driving pulley 62 carried on a shaft 20 on which the drum 2 is mounted. The image-forming characters 65 or character elements 1 are inked by a roller 59 which engages the image-forming characters 65 and is fed with ink from a fountain 5.

Stretchable plastic tape 6, which may be transparent polyester or polyvinylchloride tape of 10 microns thick and 10 millimeters wide, is fed from a storage reel 7 and passes over a pivotable platen anvil 8 onto a conveying belt 9. The platen anvil 8 is pivoted by a solenoid 16 which is actuated to place the tape 6 passing over the platen anvil 8 into contact with a selected image-forming character 65 in a character element 1 on the drum 2 and thus to place the image of the character 65 onto the tape 6.

Figure 2A:
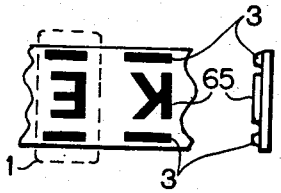
FIG. 2*a* is a plan and elevation of a portion of the surface of the drum.

Each character element 1 is upstanding from the surface of the drum 2 and contains tape driving lands 3 above and below an image-forming character 65, as shown in FIGS. 2 and 2*a*. The inking roller 59 is of such a width that it inks the image-forming characters 65 but not tape driving lands 3. The tape driving lands 3 in each character element 1 are equal in length to that of the image-forming character 65 plus the normal space between character images, as, for example, in a word. The driving lands 3 serve the function of limiting the pressure of the platen anvil 8 on the image-forming characters 65 to give even inking on the tape 6 and, by frictional contact with the tape 6, to advance tape 6 on the platen anvil 8 the distance necessary to give correct spacing for characters of different length.

As shown in FIG. 2, the drum 2 has ten character registers such as 49, 50 and 51. Each of the character registers such as 49, 50 and 51 holds image-forming characters 65 of one typographic size and style though all of the image-forming characters 65 of one typographic size and style may be contained on more than one character register such as 49, 50 and 51. For example, each character register such as 49, 50 and 51 can hold thirty-five character elements 1 plus one space element 67 with one character register, such as 49, holding image-forming characters 65 for capital letters and basic punctuation marks, a second, such as 50, holding image-forming characters 65 for lower case letters and basic punctuation marks, and a third, such as 51, holding image-forming characters 65 for numbers, symbols, and punctuation marks that are used less frequently. One of the character elements 1 in each character register such as 49, 50 and 51 has an end-of-line image-forming character 55 which is a bar or solid area. In addition to character elements 1, each character register has one or more space elements 67 containing tape driving lands 3 only and this is used to advance the tape 6 to place additional space between characters, as for example, between words, or to advance the tape 6 for other purposes.

The drum 2 is keyed to the shaft 20 and is axially movable along the shaft. As shown in FIG. 2, the drum 2 is in a position to place capital letter character images from the register 49 onto the tape 6 but the drum 2 can be moved axially on the shaft 20 by means of pinion 52 and rack 53 in engagement with flange 54 in order to place character images 65 from another character register such as 50 or 51 onto the tape 6.

The drum 2 is arranged so that the different combinations of character registers such as 49, 50 and 51 can be located on the drum 2 according to the various typographical requirements for the work to be done and it will be appreciated that fewer or more than ten character registers, as depicted in FIG. 2, can be accomodated depending upon the length of the drum 2, and that all character register positions on the drum 2 need not be filled. Character registers can be metal discs with character elements 1 and space elements 67 cast on their peripheries and they may be separately mountable on the hub 57.

Each of the character registers such as 49, 50 and 51 has the same number of character element and space element positions and the positions of any one register are in alignment with those of the others such as along a line 56 (FIG. 2). Similarly, image-forming characters 65 in different registers are located along the same line, thus, as shown, image-forming characters "E", "e" and "3" are in one character element position and they are in the same character element position in other character registers of drum 2, for example, those that contain italic or bold-face image-forming characters 65.

Referring now to FIG. 3 in conjunction with FIG. 2, the apparatus has a keyboard similar to that of an ordinary typewriter with a key such as 11 for each character element position on the character registers plus another key (possibly a bar) for the space element position. An apparatus with character registers such as 49, 50 and 51 with thirty-six character and space element positions would then have thirty-six keys on the keyboard that are operably identical to key 11. When key 11 is pressed it closes a switch 14 and applies an electrical potential to a commutator segment 13 formed on a commutator disc 12 mounted in a fixed position on a rear bearing support 64. There is a segment such as 13 for each key such as 11 on the keyboard and hence for each character and space element position on the character registers such as 49, 50 and 51. The disc 12 also has a slip ring 15 radially inwardly of the segment 13 and electrically connected to the solenoid 16 for the platen anvil 8. The solenoid 16 is energised whenever the circuit is completed between the slip ring 15 and a segment such as 13.

A brush holder 17 is mounted on the shaft 20 for rotation therewith and the brush holder 17 carries brushes 18 and 19 radially displaced from one another so that the brush 18 makes successive contact with the segments such as 13 and the brush 19 makes continuous contact with the slip ring 15. The brushes 18 and 19 are electrically connected to one another.

In the operation of the typesetting means, the drum 2 turns continuously and the operator moves the drum 2 axially until the desired character register is in line with platen anvil 8 so that character images from image-forming characters 65 on that register can be placed on tape 6. The drum 2, the brush holder 17 and the disc 12 are mutually aligned so that the brush 18 contacts a segment such as 13 at the time when image-forming character 65 associated with that segment enters the printing position adjacent to the platen anvil 8.

When each key such as 11 is pressed its associated segment such as 13 is energized and when the drum 2 has rotated to a position where the selected image-forming character 65 is in a position to place its image on the tape 6, the brush 18 makes contact with the associated segment such as 13 thus completing the circuit to the solenoid 16 which moves the platen anvil 8 a small distance toward the character element 1 thus placing that part of the tape 6 on the platen anvil 8 in contact with the image-forming character 65 and placing the character image onto the tape 6. As the character image is placed on the tape 6, the tape driving lands 3 frictionally engage the tape 6 to move it on the platen anvil 8 the distance necessary for the tape 6 to receive the character image plus an additional distance to provide a small space between this character image and the next one (say, in the same word) that will be placed on the tape 6.

There will now be described the composing section of the typesetter including the justifying means of the invention. The composing section cuts the tape 6 from the roll 7 into segments each containing a single line of character images and stretches the segments as may be necessary to equalise the lengths of the lines of character images so that all are of the length established by the column width of the work in hand. In addition the stretched segments of tape 6 are applied one below the other to a backing surface as a justified column that can be used to prepare a plate for lithographic printing.

FIG 4 shows feed means for a transparent film backing material in which the transparent film 21, of a width at least equal to that of the column to be set, is stored on a roll 22 and passes under the body of the composing section of the apparatus, around a roller 23, under a sheet of glass 24, and between rollers 25 and 26. In FIG. 1 the glass 24 and the film 21 are shown but the film 21 is shown as it would appear on the roller 23, the roller 23 having been omitted for clarity.

Referring again to FIG. 1, the tape 6 is conveyed by the belt 9 driven by a wheel 10 which is in turn driven by a motor 4. The wheel 10 is rotated continuously in a counter-clockwise direction, as shown, during most of the operating cycle. The belt 9 is formed of elastic, translucent material such as natural rubber and is of about the same width as the tape 6.

The width of a column of type to be composed and the position of the column on the backing film 21 are set by positioning a left-hand margin stop 27 and a right-hand sensing and clamping head 28 on rods 29 and 30 extending parallel to the position of the belt 9 adjacent thereto. A left-hand sensing and clamping head 31 is held captive to the stop 27 by headed stop pin 68 but is movable relative thereto on the rods 29 and 30. The maximum spacing of the stop 27 from the sensing and clamping head 31 is, in this case, about 12 millimeters, and the sensing and clamping head 31 is biased towards this position by a spring 60.

The left-hand sensing and clamping head 31 has a light-sensitive diode 32 located under the conveying run of the belt 9 and the diode 32 is capable of detecting the image of the end-of-line image-forming character 55 which is placed at the beginning and at the end of each line of character images. The sensing and clamping head 31 has a solenoid 36 which, when operated, pulls a rod 35 down into a groove 34 (FIG. 1*a*) thus clamping a segment of tape 6 and the belt 9 together. A fine wire 40 is located on the underside of the rod 35 and is insulated from the rod 35. An electric current can be passed through the wire 40 to heat it whereupon it is capable of cutting through the tape 6. This is achieved without damaging the belt 9 by controlling the duration and amount of heating involved. The right-hand sensing and clamping head 28 is the same in construction as the left-hand sensing and clamping head 31 except that its position on the rods 29 and 30 is fixed when the position of the right-hand margin is set. The sensing and clamping head 28 has a light-sensitive diode 61 and a solenoid 39 arranged so that when the diode 61 is energised the solenoid 39 pulls the rod 37 down to clamp the tape 6 and the belt 9 into a groove 38. A cutting wire 40 is also located under the rod 37.

A further solenoid 42 having an associated rod 41 and cutting wire 40 is located at a fixed position near the platen anvil 8 so as to be able to cut the tape 6 without any clamping action.

The light-sensitive diodes 32 and 61 are arranged to receive light from a light source 33 after it has passed through the glass 24, the film 21, the tape 6, and the belt 9. The rods 29 and 30, the sensing and clamping heads 28 and 31, and the stop 27 supported on the rods 29 and 30 constitute a carriage 66 which can be raised by rotating a rod 46 carrying cams 47 and 48. The rod 46 can be turned through one revolution by motor 4 and one-turn clutch 69 to raise the carriage 66 so as to press the tape 6 on the belt 9 into engagement with the underside of the film 21.

In operation, the operator presses a key such as 11 to cause the end-of-line character image to be placed onto tape 6 and then advances the tape a short distance (say, three lengths of the space element); the distance being determined by the distance between light-sensing diode 32 and cutting wire 40 along the run of belt 9. A line of character images is then placed on tape 6 by successively pressing keys such as 11, at least one of which keys is associated with a space element 67 and causes space along the run of tape 6 to be introduced between groups of character images, say, between words. When the image of the end-of-line character 55 reaches the right-hand end of marker 43 (FIG. 1) the operator examines the line and, if free from errors, types the remaining characters that may be necessary to reach the nearest word ending or division point. The operator then advances the tape a distance depending upon the distance between light-sensitive diode 61 and cutting wire 40 on bar 37 and places another end-of-line character image on tape 6. Additional tape is then spaced out to bring this end-of-line character image just to the left of rod 41 and its cutting wire 40; solenoid 42 is then energised and cutting wire 40 is heated to cut the tape 6.

The marker 43 indicates the range of line lengths which can be stretched to the width of the column of type being set.

The distance from the right-hand end of marker 43 to the platen anvil 8 is the length of the shortest line that can be stretched without breaking the tape 6 or unduly distorting the character images, and the distance from the left-hand end of marker 43 to the platen anvil 8 is the length of the longest line that will leave no slack in the tape 6 when pulled to full colunn width. In practice, a segment of tape 6 can be stretched to about 10% greater than its original length before any distortion of the character images upon it becomes evident. Thus normally the ends of the marker 43 would be spaced apart a distance equal to 10% of column width. The marker may be positioned mechanically or electrically or can be in the form of grease pencil marks put on the glass 24.

When the tape 6 has been cut by the cutting rod 40 associated with rod 41, it moves leftward with the moving belt 9 until the end-of-line character image at the beginning of the line reaches the light-sensitive diode 32. The end-of-line character image then interrupts the light coming from the light source 33 and causes the solenoid 36 to be energized to clamp the tape 6 and the belt 9 together. After this clamping operation, the diode 61 is operated into a sensing condition.

With the moving belt 9 now clamped to the sensing and clamping head 31, the sensing and clamping head 31 moves leftward with belt 9 by sliding action along rods 29 and 30. If the distance between the images of the leading and trailing end-of-line characters is such that the line of character images on the segment of tape 6 is within stretchable range, with respect to the column width of the work, light-sensitive diode 61 will have light received from light source 33 interrupted by the trailing end-of-line character image before sensing and clamping head 31 reaches the left-hand margin stop 27. This interruption of light to light-sensitive diode 61 causes the solenoid 39 to be operated to clamp the belt 9 and tape 6 by means of the rod 37 and the groove 38. The trailing or right-hand end of the segment now being clamped, any further leftward movement of the belt 9 and the sensing and clamping head 31 stretches the belt 9 and the segment of tape 6 and with it the line of character images on the segment of tape 6. It will be noted that an idler roll 45 engaging against the belt 9 and the wheel 10 prevents slippage of the belt about the wheel. When the left-hand sensing and clamping head 31 reaches the stop 27, a switch 63 is operated to stop the belt 9 and apply a current through the heating wires 40 of the sensing and clamping heads 28 and 31 and also energises a solenoid and one-turn clutch 69 to turn the rod 46 and cams 47 and 48 and thereby to raise the carriage 66, the sensing and clamping heads 28 and 31 with the belt 9 to place the stretched segment of tape 6 into contact with the film 21. As the cams 47 and 48 begin to lower the carriage 66 to its initial position, the solenoids 36 and 39 are de-energised to release the belt 9 and leave the stretched segment of tape 6 attached to the film 21. The segment of tape 6 attaches itself to the film 21 through a static electrical charge in the tape 6 which is believed to be created by the belt 9 moving under the tape 6. As the solenoids 36 and 39 are released, the diode 61 is desensitised and the film 21 is advanced by turning the roller 23. As the film is advanced, it passes between the rollers 25 and 26 and the roller 26 is electrically heated by heater element 70 to anneal the segments of tape 6 to the film 21 and remove any entrapped air bubbles.

If the operator makes an error in setting a line of character images, the whole line or a partial line can be rejected by cutting the tape 6 through actuation of the solenoid 42 and heating the cutting wire 40 associated with rod 41. The rejected segment of tape 6 is carried along belt 9 and is removed by a scraper 44 as it passes over the wheel 40.

It will be appreciated that various alternative features can be incorporated without departing from the scope of the invention. For example, an opaque backing medium may be used instead of transparent film 21, in which case, character images can be placed on either transparent or opaque tape 6 which can then be stretched in the manner described and applied to the backing medium in a form that can be photographed as a step in preparing a lithographic plate. As another example, character images can be placed on tape 6 by methods other than applying ink to image-forming charactes 65 and placing the tape 6 in contact with them. As a further example, the segments of tape 6 can be placed on the transparent film 21 in various positions to provide such options of composition as centred headings and non-justified margins.

It is envisioned that various advantages should arise by use of the invention described, as follows:

1. The operator can inspect the lines as they are being set and easily reject any line which contains an error.

2. When the tape 6 is stretched, the characters and spaces are lengthened an equal amount thus producing copy in which the justification spacing cannot be readily discerned.

3. Copy can be produced by the apparatus ready for imposition without the intervening steps hitherto necessary.

4. Word division is in the control of the operator.

5. As the copy being set is directly in view of the operator, composition can often be done as the type is being set, thereby eliminating or reducing film stripping operations.

I claim:

1. An apparatus suitable for placing character images on tape comprising a rotatable drum, a circle of distributed image-forming characters on the peripheral surface of said drum, said image-forming characters oriented with lengths circumferential to said drum and in mutual typographic alignment, lands raised above the datum peripheral surface of said drum, means for rotating said drum, and means for placing an image receiving medium in the form of tape in contact with said image-forming characters and said lands in order to place character images on said tape and to advance said tape by contact between said lands and said tape.

2. In a typesetting apparatus in which tape is the image receiving medium, means for proportionally spacing character images on said tape comprising a rotatable drum, a circle of distributed character elements on the periphery of said drum, a character element consisting of, an image-forming character oriented with its length circumferential to said drum and in typographic alignment with the image-forming characters in other said character elements of said circle, and, a land raised above the datum peripheral surface of said drum, said land of circumferential length equal to that of said image-forming character and an intervening space between an image of said image-forming character and an adjacent character image on an image receiving medium, means for rotating said drum, means for placing an image receiving medium in the form of tape in selective contact with said character elements in order to place character images on said tape and by contact between said lands and said tape to advance said tape in order for said tape to receive spaced images from image-forming characters of different lengths.

* * * * *